US007079014B2

(12) United States Patent
Steinetz et al.

(10) Patent No.: US 7,079,014 B2
(45) Date of Patent: Jul. 18, 2006

(54) DIGITAL SAMPLING PLAYBACK DOORBELL SYSTEM

(76) Inventors: Scott Steinetz, 29 Tracey La., Sparta, NJ (US) 07871; Mike Palazzi, 60 Midvale Rd., Mountain Lakes, NJ (US) 07046

( * ) Notice: Subject to any disclaimer, the term of this patent is extended or adjusted under 35 U.S.C. 154(b) by 85 days.

(21) Appl. No.: 10/841,875

(22) Filed: May 8, 2004

(65) Prior Publication Data

US 2005/0248443 A1 Nov. 10, 2005

(51) Int. Cl.
*G08B 3/00* (2006.01)

(52) U.S. Cl. ..... 340/392.1; 340/384.1; 340/384.5; 340/384.7; 700/94

(58) Field of Classification Search ..... 340/392.12, 340/384.1, 384.5, 384.7; 381/61; 700/94
See application file for complete search history.

(56) References Cited

U.S. PATENT DOCUMENTS

| | | | | |
|---|---|---|---|---|
| 3,002,187 | A | 9/1961 | Spear | 340/328 |
| 4,280,123 | A | 7/1981 | Right et al. | 340/384 |
| 4,375,061 | A | 2/1983 | Shoff | 340/384 E |
| 4,687,296 | A | 8/1987 | Terayama et al. | 358/814 |
| 4,768,022 | A | 8/1988 | Patterson | 340/384 E |
| 5,365,214 | A | 11/1994 | Angott et al. | 340/328 |
| 5,428,388 | A | 6/1995 | Von Bauer et al. | 348/155 |
| 5,570,083 | A | 10/1996 | Johnson | 340/692 |
| 5,774,039 | A | 6/1998 | Houseley | 340/326 |
| 5,867,818 | A | 2/1999 | Lam | 704/270 |
| 5,973,591 | A | 10/1999 | Schwartz et al. | 340/384.7 |
| 6,545,595 | B1 * | 4/2003 | Xydis | 340/392.1 |
| 2001/0046304 | A1 | 11/2001 | Rast | 381/74 |
| 2003/0033214 | A1 | 2/2003 | Mikkelsen et al. | 705/26 |
| 2003/0043047 | A1 | 3/2003 | Braun | 340/691.1 |
| 2003/0080855 | A1 | 5/2003 | Koneff et al. | 340/328 |
| 2005/0100170 | A1 * | 5/2005 | Chen | 381/59 |

FOREIGN PATENT DOCUMENTS

| | | |
|---|---|---|
| DE | 199 61 145 A | 6/2001 |
| DE | 100 32 909 A | 1/2002 |

OTHER PUBLICATIONS

Timely Products/CLT Enterprises: musical programmable doorbell.

* cited by examiner

*Primary Examiner*—Julie Bichngoc Lieu
(74) *Attorney, Agent, or Firm*—Ernest D. Buff & Associates, LLC.; Ernest D. Buff

(57) ABSTRACT

A digital sampling playback doorbell system has two or more doorbell buttons and a central unit with solid-state memory storage for multiple digitally sampled sound files. User assignment means are provided for assigning a particular sound file to a particular doorbell button. The digital sampling playback doorbell m has computer interface of RS-232, or USB, or infrared wireless connection type and relies on computer installed software to download digitally sampled sound files stored in the computer hard drive to the memory of the digital sampling playback doorbell system central unit. The digitally sampled sound files stored in the computer hard drive are obtained by accessing a web site through the Internet or capturing sound through an audio computer connection to a microphone, CD player or radio broadcast using software resident in the computer.

14 Claims, 2 Drawing Sheets

DIGITAL SAMPLING PLAYBACK DOORBELL SYSTEM

BACKGROUND OF THE INVENTION

1. Field of the Invention

The present invention relates to a doorbell system that plays back one or more high quality digitally sampled sound files when activated by pressing one of a plurality of doorbell buttons wherein the digital sound files are either recorded or downloaded from an Internet website.

2. Description of the Prior Art

Many patents address issues related to doorbells and providing doorbell sounds. Several of the prior art patents disclose analog devices that use a recording device. Some of the doorbell devices are digital devices and provide digitally created sounds. None of these devices, however, incorporate digital sound files that are downloaded into the memory of a doorbell device from an Internet website together with the capability for recording digital sound files.

U.S. Pat. No. 3,002,187 to Spear discloses a door chime. It uses one or more tone bars that are electro mechanically energized and the door chime has a resonant chamber to amplify the sound. In addition, the coil energizing the tone bar is connected to an amplification system to produce audible sound in a home intercommunication system. This door chime cannot produce any sound other than that which is a tone bar frequency. The sound produced in the home communication system by the '187 patent is a monotone frequency. It does not generate music, voice and the like, when the door chime is activated.

U.S. Pat. No. 4,280,123 to Right et al. discloses a multitone signaling device. The '123 patent discloses a compact and economical circuit for a multitone horn which includes a microcomputer, an audio amplifier, a speaker, a power supply, and start control means with a common lead and a plurality of star leads. Connecting the common lead to a predetermined one of the start leads will initiate a predetermined one of the plurality of available tones. The available tones include both percussive and non-percussive tones, and the total number of available tones may be greater than the number of start leads. The '123 patent discloses a stand alone multiple tone audible signaling device capable of selectively producing one of a plurality of 13 distinguishable signals, amplifying the signal, and producing an audible sound through a speaker using a local power supply. Devices disclosed by the '123 patent cannot produce any sound other than these specific computer generated synthesized sounds. They do not generate music, voice and the like, when they are activated.

U.S. Pat. No. 4,375,061 to Shoff discloses a digitally driven audio effects generator. The digitally driven audio effects generator includes a source of binary information and keyboard which provides digital information to a plurality of source or sink type binary drivers. A ladder matrix is coupled to the binary drivers and provides an output signal. An audio frequency signal generator responds to the keyboard and controls an interrupting switch, which serrates the output signal at an audio frequency rate. The analog frequency sound output is generated by rapid switching of a digital signal with high and low voltage levels. This device can only produce mixtures of pure single frequency and cannot generate complex sounds like voice or music.

U.S. Pat. No. 4,768,022 to Patterson discloses an apparatus for generating auditory indicators. The '022 patent states that existing auditory warning systems are in general too loud and it is often difficult to distinguish between a number of different warnings. Further, under different conditions warnings may change character due to masking by varying noise. A warning system is based on a microprocessor and waveforms for each warning sound stored in a ROM. The waveforms are read out to digital-to-analogue converters (DACs) and used to drive a loudspeaker by way of programmable attenuators. Each waveform is devised to have at least four quasi-harmonically related frequency components at a power level in the range 15 to 30 dB above threshold. In this way the sounds are distinctive and do not change character with varying noise levels below threshold. The '022 patented device is designed to output a warning announcement through speakers selected from a set resident in the PROM together with noise cancellation based on noise levels measured by sensors at four different frequency values, improving the clarity of the warning message. Such a device is not a door chime but is rather a public address system with noise cancellation capabilities.

U.S. Pat. No. 5,365,214 to Angott et al. discloses a musical wireless alerting system. The musical wireless alerting system includes several detectors, which transmit RF signals to a common receiver. The detectors include manual switches to allow manual selection of a song or melody. The selection is coded in the form of an audio code, which is transmitted to the receiver. The receiver detects any RF transmissions and verifies that the received transmissions are identifiable with a receiver and reads the audio code. The audio code is compared with a plurality of stored songs or tones within memory for transmission to a speaker, which plays the tone or song. Each of the detectors sense different predefined conditions and indicate different audible indications to be played. The detectors may sense conditions such as opening of the door or depression of a doorbell. Several detectors with switch selectors for tone or song selections communicate by radio frequency to a central receiver. When the detector senses a predefined condition such as the opening of a door or the pressing of a doorbell, it communicates the predefined condition to the central receiver and also a code corresponding to the switch selection. The receiver plays an appropriate tone or song through the speaker system corresponding to the transmitted code. The songs and tones are resident in the memory of the receiver; are not changeable. They cannot be downloaded from an Internet website using a computer. Detector sensors are not hardwired to the receiver and represent several predefined conditions, not specifically a door chime mechanism.

U.S. Pat. No. 5,428,388 to Von Bauer et al. discloses a video doorbell system. A communication apparatus monitors sounds and images at a remote sensor station location, such as the entranceway of a dwelling. The apparatus includes a sensor station located at the entranceway, and a monitor station located within the building. A television camera and microphone at a sensing station close to the entrance of a building are triggered by pressing of a doorbell or infrared sensing of the presence of a person at the entrance doorway. The sensor station transmits the voice and video images by radio frequency to a monitoring station inside the building. The monitoring station can communicate by voice to the doorway allowing the user to speak with the person at the entrance door. This video doorbell system does not select from different tones, music or voice recordings when the doorbell is pressed. It does not have the capability of reprogramming the musical, vocal or tonal notes resident in the doorbell chiming circuitry.

U.S. Pat. No. 5,570,083 to Johnson discloses a doorbell/answering system. The doorbell system presents a normal doorbell alarm with an alternative speech record/playback assembly. Upon depression of the exterior button extending through an exterior housing adjacent a building entrance the system will either energize the doorbell or urge the visitor to leave a recorded message for subsequent playback. The doorbell and/or record modes are selected by the user by a switch located within an interior housing mounted adjacent a building entrance. The housing includes the appropriate components and wiring to provide the doorbell and record/playback functions. In the '083 patent, the occupant may choose to use either the doorbell or record a message mode for the visitor. The playback/answer system prompts the visitor with instructions before initiating the recording process. This doorbell/answering system either rings a doorbell or prompts the visitor to record a voice message for the occupant. It does not play musical notes, tones, and voice messages at the moment the doorbell is pressed.

U.S. Pat. No. 5,774,039 to Housley discloses a programmable doorbell control. An audible announcement is recorded and stored by a doorbell control module using speech controller integrated circuitry. A self-contained remote module may interface with the doorbell control module by means of a wireless intercom system. When the doorbell is actuated, the remote module transmits a tone or signal that is received and detected by the doorbell control module. In response, the doorbell control module activates an internal speech controller circuitry to generate a playback of a stored audible announcement. Similarly, a visitor can easily respond by actuating a recording actuation means to activate a microphone for generating a responsive audible message that can be transmitted to the control module for encoding and storage. In this manner, the visitor's audible message is encoded, recorded and stored by the speech controller integrated circuitry of the control module for playback. The '039 patented device plays a pre-recorded digital message to the visitor when the doorbell is pressed in the automatic mode and the visitor is provided means to record a digital voice message for the occupant. The doorbell is wirelessly connected to a controller, which plays the recorded digital message provided by the occupant or digitally records the visitor's response. The programmable doorbell control does not have a multitude of digital samples of voice, music and the like that function as the sound generated by a door chime. The doorbell controller is not hardwired to the doorbell and is not capable of accessing digital samples from an Internet website.

U.S. Pat. No. 5,867,818 to Lam discloses a programmable sound synthesizer apparatus. The programmable sound synthesizer has specialized hardware and programming methodology which includes filling two tables in order to represent a sound pattern. This device may be used in many electronic goods, but it is not a doorbell chime. It does not digitally record any sound, but instead synthesizes sound pattern based on entries in the two tables.

U.S. Pat. No. 5,973,591 to Schwartz et al. discloses an electronic signaling system. Said electronic signaling system comprises a base unit including an audio media player for reproducing a recorded audio signal from an inserted recorded medium, and an audio output stage for producing an audio output responsive to the occurrence of a trigger signal. A remote triggering device, such as a doorbell, includes a signal generator for communicating energy from the triggering device to the base unit. A receiving device in the base unit is provided for intercepting the energy communicated from the triggering device for reproducing the recorded audio signal. The medium may be a replaceable medium, permitting the user to select, from a variety of sound recordings, which recording is to be played back when a visitor or a guest pushes the doorbell. The replaceable medium may be recordable by a user. The audio player is preferably a player capable of reproducing sound patterns from integrated circuits containing encoded or non-encoded sound program information. A simplified electronic signaling system may be placed in a child's room. When a pushbutton outside the child's room is pressed, a preselected sound/audio/song/message/program is played by the base unit in the child's room. The base unit may have a slot for receiving thematic cards having artwork thereon and carrying an IC containing sounds or sound patterns consistent with the theme depicted on the thematic card. In this manner, the child may enjoy listening to one of his or her favorite sounds, songs, tunes, noises, voices, etc. while viewing, through the base unit window, a picture having the same theme as the sound recording. The '591 patented system uses a base controller connected to house power and has an antenna for receiving remote triggering signal. Upon receipt of the signal, the sound pattern stored in the clip chip module is amplified and played on a speaker connected to the base controller. The entire contents of the clip chip module, which may be analog or digital, is played and is not capable of being individually selected according to the requirements of the user. The base controller does not communicate with more than one remote trigger device. The trigger device is not hardwired to the base controller.

U.S. Pat. No. 6,545,595 to Xydis discloses a CD quality wireless door chime. A doorbell system having a sound memory for storing and playing a CD quality doorbell sound is disclosed. The doorbell system includes a receiver unit for receiving an indication of a doorbell button being pressed, a code detector for commanding the sound memory to output stored sound signals and sound producing means for outputting a CD quality sound. Also disclosed is a method for storing a CD quality sound into a doorbell system. In the '595 patented device the sound file is digitally recorded, filtered and converted into an analog sound and stored in a sound memory chip and played when the doorbell is pressed. It is not a digital sampling playback and the sound file is not selected from a number of sound files. The sound file is analog, not digital, and is not capable of being updated using a website.

US Published Patent Application No. 2001/0046304 to Rast discloses a system and method for selective control of acoustic isolation in headsets. It comprises an apparatus and method for providing controlled acoustic isolation within various forms of headsets. The selective control of acoustic isolation provides manual and automatic mechanisms for changing the amount of acoustic isolation provided by the headsets. Sounds in the environment that the user wishes to be made aware of can be programmed into a set of stored sound selection characteristics. In response to correlation of the stored sound characteristics with sounds in the external environment the headset decreases acoustic isolation by coupling signals from one or more external microphones to the audio conversion elements within the earpieces. Alternatively, the apparatus can respond to sounds to be blocked by increasing acoustic isolation. A manual control may be activated by the user to decrease acoustic isolation at their discretion. The '304 device uses speech recognition to allow critical words and has means for the user to listen to environmental noises or attenuate them. The '304 patent application does not disclose a door chime which plays digitally sampled sounds according to the preference of the user.

US Published Patent Application No. 2003/0033214 to Mikkelsen et al. discloses a media delivery platform. The media delivery platform includes the use of sound and/or image clips, which can be snippets or full files, as alerts for a variety of electronic devices. A collection or library of uniquely selected and/or edited clips may also be provided to the consumer on conventional telephone equipment. Algorithms are provided for the delivery, storage and playback of the sound files, including a delivery method algorithm, a parametric optimization and compression algorithm, and an error correction algorithm. In contrast to the conventional ring tones or musical chimes used to ring cellular phones currently on the market, the current invention provides a method for ringing cellular phones and landline telephones with real sound recordings including real music, which may be songs lifted from copyright registered CD tracks, and may comprise human voice, various instrument sounds, and other sound effects of a high quality. A software based system for encoding the hardware of existing cellular phones at the time of manufacturing with delivery, storage, and playback capabilities is provided, such that additional hardware is not required. No disclosure is contained within the '214 patent concerning a doorbell chime system having different digitally sampled sound clips.

US Published Patent Application No. 2003/0043047 to Braun discloses an electronic doorbell system. Said doorbell arrangement identifies visitors. The doorbell arrangement includes a user interface that allows a visitor to indicate that he is visitor or provide a user code. The doorbell system identifies the visitor and generates response signals specific to each visitor. This response signals include audible sounds such as musical tones or voice recordings. The response signals also include radio frequency signals transmitted to remote locations. The doorbell arrangement may include a computer such as a personal computer. This '047 patent application discloses an electronic doorbell system. The visitor is identified by a user code, which is used to activate a specific musical sound or a voice announcement when the doorbell is pressed. Means are provided to record various announcement messages and associate with a specific user code. This electronic doorbell system does not import specific or digital sampling music patterns from a website. The logic circuit carries only announcement patterns according to specified visitors and any specific digital sampling music pattern is not selectable by the user. If a new visitor arrives at the door and does not have a user code, it is unclear what the system would do.

US Published Patent Application No. 2003/0080855 to Koneff et al. discloses a doorbell system. Said doorbell system includes first and second pushbuttons and an RF transmitter activatable by the first and second pushbuttons. An RF receiver is configured to receive RF signals from the RF transmitter. The doorbell system further includes a microphone. A first storage device of the doorbell system stores a first sound. A second storage device is configured to record a second sound through the microphone. A playback device is operatively associated with the RF receiver and the storage devices to enable a user to select one of the sounds by pressing sequentially the first pushbutton and to play the selected one of the sounds by pressing the second pushbutton. The unit does not receive digitally sampled sound files from a website.

Foreign. Patent No. DE 10032909 to Fries discloses a programmable sound generator for signaling systems in buildings such as doorbell systems. The programmable sound generator has means enabling the owner or tenant of a building or the persons installing the system to store a noise, sound, music, etc. When a signal is released, the stored sound is played. The arrangement can be integrated with an existing doorbell or with entry security systems. The system may be arranged in a removable box with plug contacts. The '909 foreign patent discloses a doorbell with a programmable sound generator wherein the programmed sound is played when doorbell is pressed. Such a doorbell has only one sound. It does not provide a selection of digital sampling playback, and it is not connected to a website for acquiring digitally sampled sound files for use in the door chime. Foreign. Patent No. DE 19961145 to Hartmann discloses a setting call/bell signal that involves placing individually selected sounds or noises from external source into memory in sound acquisition/reproduction device for retrieval by initializing signal. The sounds or noises are acoustically retrieved when an initializing signal is fed into the sound acquisition and reproduction device, e.g. a mobile or static telephone or a doorbell. A RAM chip can be used as the storage medium. The '145 foreign patent discloses a system for placing selected sounds in a static telephone or mobile phone or doorbell. Such a system is not connected to a website for receiving digitally sampled sound files for use in a door chime.

Internet Publication "Home Security" at source(s): www.10-best-home-security.com discloses getting your wireless doorbells, decorative doorbells or programmable doorbell buttons over the Internet. 'Maybe you are looking for something a little different for your decorative doorbells. With some models you can program your wireless doorbells to play your favorite music or song when your doorbell button is pressed. There are units on the market that will allow you to record CD quality chime sounds, music or voice messages. An external jack allows you to plug into your computer, radio or CD players. Just think of the fun you can have as you record and change your 10-second doorbell chime. For creative design, reliable suppliers, state-of-the-art manufacturing and stellar products shop online today'. The units provided store a 10 second clip of song and play only one sound clip when the doorbell is activated. The Internet is used only to purchase the doorbell devices and is not used to download sound files. Further, the unit is incapable of selecting clips from a multitude of choices; and it is not connected to a website for downloading digitally sampled sound files.

Internet Publication "Programmable Doorbell" at www-.timelygifts.net discloses programmable doorbells. 'Welcome to Timely Gifts, home of the famous, ONE and ONLY Musical Programmable Doorbell, the only door chime easily programmed with any tune. If you can press a button/you can program in your favorite song. Musical doorbells are not all the same! Don't be fooled by cheap-sounding imitations. Only the Programmable Musical Doorbell from Timely Gifts gives you the option to easily and quickly program ANY of your own favorite songs any time you like, from patriotic tunes to popular standards, sports charge, sport fight songs, Christmas songs, military songs, anything you want to hear! Or, choose from one of the 48 pre-programmed tunes already installed (see list at left and HEAR them now). Enhance your home's Feng Shui and enjoy lovely music when the musical chime rings in your home. What a great; unique gift! IN STOCK- . . . Only $48.95! Order Now'. The programmable doorbell is purchased through the Internet and no sound files are downloaded into the programmable doorbell using a web-based connection. This allows programming of only one song and it is not clear if it includes digital samples. Further, the unit does not have the ability to download a digitally sampled sound file from a website.

Internet publication at http://www.bintin.de/catalog/product_info.php?cPath=6&products_id=46 discloses a High-quality designer door chimes with the hi-fi sound for $109.90. A compact device is said to be connected to one or two doorbells with 11 preprogrammed melodies and Three slots (2×8 seconds, 1×40 seconds) for downloading individual melodies, sound effects or announcements from a PC to the Hi-Fi Door Chime using cables and software, which are provided. The device has only limited capacity to provide three short melodies and does not have a website to connect to for receiving sound files.

There remains a need in the art for a doorbell system that has a multitude of digital sound files stored in the memory, which can be selected by the user to assign sound files for different doorbell activators. Additionally needed is a method and means for updating the sound files easily, which includes the capability of downloading high quality sound files from an Internet web site as well as recording and storing specific sound files.

SUMMARY OF THE INVENTION

The present invention provides a digital sampling playback doorbell system (the "Digital Sampling Playback Doorbell System") having a central unit connected to electrical power and attached to two or more doorbell buttons or activators by hardwire connections. The central unit of the digital doorbell system has a large solid state memory storage for storing digitally sampled sound files and buttons to aid in the assignment of stored sound files to specific doorbell buttons, so that when the doorbell button is pushed the user selected sound file is played. The sound file selection is sequential and is effected by pressing and holding the doorbell button selection down and pushing the up and down navigation button to scroll through the stored sound files one at a time and then releasing the doorbell selection button when the sound file selection is made. The central unit of the digital sampling doorbell system also contains an amplifier and is connected by hardwire to speakers through which the sound files are played in high quality sound. The central unit may also have an infrared output, which communicates with a remote powered speaker to provide stereophonic sound file playback when the doorbell button is pressed. The central unit also has the capability to transmit AM or FM signal that may be picked up by a standard radio receiver. The central unit of the digital sampling doorbell system is simple in construction and relies on a computer interface connection to download sound files into the memory of the digital sampling doorbell system central unit. The software for this download is resident in the computer, not in the central unit of the digital sampling doorbell system. The computer downloads sound files from a website through an Internet connection or directly records CD player, music radio broadcasts, or microphone generated sounds as a digitally sampled sound file into the hard drive of the computer, for example, through a sound card and audio hook up port. The software for both Internet downloading and audio capturing are resident in the computer. The central unit has a random access memory with a capability of greater than 4 MB and can store 8, 16 and/or 24 bit sound files sampled over 4 –32 KHz frequency range.

The digital sampling playback doorbell system may include an internal clock and software for determining what greeting to use based on time of the day such as 'Good Morning" etc., and greetings based on time of year, such as Christmas, Valentines day or Halloween.

Key features associated with the use of the Digital Sampling Playback Doorbell system include, in combination, the means set forth below:

1. Memory means sufficient to store a multitude of digitally sampled sound files.
2. User programmability means for providing the ability to assign a particular digitally sampled sound clip or file to any one of the many particular doorbells, which are hardwired to the Digital Sampling Playback Doorbell system.
3. Sound production means including an amplifier and hardwired speaker hardware for playing digitally sampled sound files when a particular doorbell is pressed, according to the user programmed voice, musical or tonal selection.
4. Computer connection means for connecting the Digital Sampling Playback Doorbell to a computer through an RS-232 or USB or infrared wireless connection, the connection means including first software means resident in the computer for downloading digitally sampled sound files from the computer hard drive to the Digital Sampling Playback Doorbell system.
5. Imput means connected with the computer through an RS-232, or USB, or infrared wireless connection, and associated with a microphone or external sound input to record digitally sampled music into the computer's hard drive, the imput means including second software means for downloading said digitally sampled recorded sound files into the Digital Sampling Playback Doorbell system.
6. Internet access means connected to the computer through a RS-232 or USB, or infrared wireless connection, connection for accessing a website and selecting digitally sampled sound files listed thereon, and third software means for downloading said accessed digitally sampled sound files into the Digital Sampling Playback Doorbell system.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
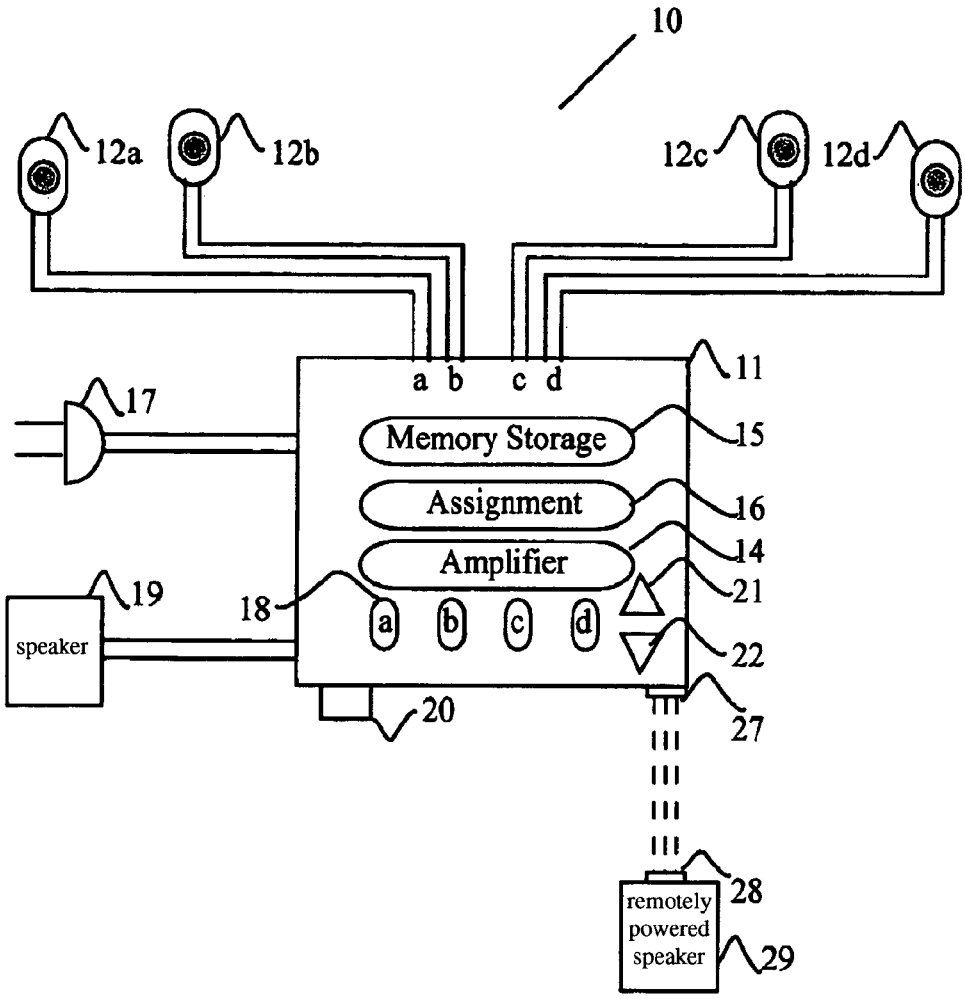
FIG. 1 depicts the schematic arrangement of the Digital Sampling Playback Doorbell system, showing the storage, amplifier and speaker connections and several hardwired doorbells.

The present invention provides a digital sampling playback doorbell that plays back a plurality of specific digital samples of digital sound files. The device has a central unit that is connected to two or more doorbell buttons or actuators by wireless connection or preferably by hardwire connection, thereby providing improved operational reliability, and is connected to speakers by hardwire or by infrared transmission. The doorbells signal the digital sampling playback doorbell system either by closing a normally open electrical contact or opening a normally closed contact. The device is designed to be a programmable digital playback machine, preferably electrically connected to a doorbell button, and can be programmed by the owner of the device to play back pre-selected sound files when a doorbell button is pressed. The device also incorporates a computer interface, which allows sound files to be downloaded to the Digital Sampling Playback Doorbell unit from the operator's computer. These sound files resident in the operator's computer may be downloaded from an Internet web site that has a multitude of sound files or are digitally sampled from a CD player tuner or a microphone attached to the operator's computer through an audio connection.

The present invention involves a Digital Sampling Playback Doorbell system central unit with large storage space in memory to store several digitally sampled sound files. The central unit includes assignment means to assign a particular digitally sampled sound clip or file to a particular doorbell, which is hardwired to the Digital Sampling Playback Doorbell system. The central unit is also provided with amplification means and hardwired playback speaker means to play the user assigned digitally sampled sound clip or file when the corresponding doorbell is pressed.

The Digital Sampling Playback Doorbell system may be fashioned with a number of options depending on the degree of complexity selected. The central unit may have the capability to directly connect either by hard wire connection or remote connection, such as infra red, infra red protocols such as IRDA, radio frequency such as FM or AM, or Bluetooth, or wireless USB, or wireless RS232 to the Internet web page to update sound files, time of day instructions, email reading, telephone message reading or indication, clock synchronization and other such features for downloading various sound files. The preferred system is a Digital Sampling Playback Doorbell system that is relatively uncomplicated in construction; it does not have means to record sound or to connect to the Internet to acquire sound files. This uncomplicated system reduces the system cost and its reliability of operation since most of the updating functions are carried out using a standard computer system with computer resident software reducing the overall component requirements of the central unit. For accomplishing these functions the Digital Sampling Playback Doorbell system depends on its connection to a computer. A computer may be connected to the Digital Sampling Playback Doorbell system central unit through a RS-232, or USB, or infrared wireless connection. Special software is provided in the operator's computer to communicate with the Digital Sampling Playback Doorbell system central unit in order to download a digitally sampled sound clip or file into the memory of the Digital Sampling Playback Doorbell system. The operator's computer can be attached to sound input means through a computer audio connection such as a soundboard to a microphone or an external sound input. A software program may be run on the operator's computer to digitally capture high quality sound from the microphone, CD player, radio, etc. which is connected to the sound input port of the computer. These sound files are typically in the form of. WAV, or so called wave files, and can be edited to change the frequency characteristics, to correct errors, or to enhance sound quality and effectiveness. These sound files are stored in the hard drive of the computer. Then a separate special program is run in the operator's computer that communicates with the Digital Sampling Playback Doorbell system central unit to download the recorded digitally sampled sound file. The computer may be connected to the Internet and access a web site which has digitally sampled sound files suitable for the Digital Sampling Playback Doorbell system which can be downloaded into the hard drive of the computer. These digitally sampled sound files may also be downloaded into the Digital Sampling Playback Doorbell system using the special software resident in the computer.

The central unit has software installed in it for tailoring the message delivered based on the time of the day. For instance, it could announce "Welcome and Good morning" before 12 pm; then change to "Welcome and good afternoon" and so on based on the central unit time clock. This programming can be best accomplished using the computer interface. This greeting function can be accomplished by the central unit independent of any other connected device, such as a computer or the Internet by using an internal clock mechanism and the ability to select one of many pre-programmed sound files in the bell's local memory. However, the Digital Sampling Playback Doorbell system could receive commands from a connected device, such as a computer or the Internet mimicking the pushing of assignment buttons, and change what sound it plays by remote commands from a web site or program running in the connected computer or other device. In an alternate embodiment, the remote connected device can supply sounds, re-program sounds or re-program or command the bell to play a specific sound at anytime. Also, the bell can be supplied a new set of time of day sounds or time of day to change the file sound remotely, then execute the programming independently of any remote command by using it's internal clock and program.

Preferably, the unit holds up to six (6) or more digital samples in memory addresses, depending upon the size and scope of the digital samples. The memory of the central unit is a type of RAM, specified in the design criteria, that when triggered by a switch, plays back the selected sound files through a transducer (typically, a 4" full range speaker). In its simplest form, the unit contains two (2) switches: a separate switch for both the front and back door. Each switch is capable of playing its own selected sound file. The sound files may be programmed by the owner, or come loaded in the device; and are chosen by audition. Once the desired sound file is chosen by auditioning it with a switch located on the actual device, then that sound file will sound whenever the switch is depressed until a new sound file is selected.

A volume potentiometer is located on the central unit's sound output, to enable the operator to control the unit's overall db range. The volume pot is sweepable in excess of 50 db and controlled with a 14 watt amplifier resident in the central unit.

The central unit also incorporates a computer interface, an RS 232 port or a USB connection that enables the central unit to communicate with a computer. The operator of the central unit is enabled at will to change the sounds which are supplied from a library of sound files especially suited for use with the Digital Sampling Playback Doorbell unit. Each of the sound files is created as a WAVE file. The sound files can be downloaded from a web site to the operator's computer and then to the Digital Sampling Playback Doorbell unit through use of the computer interface.

In an alternate embodiment the central unit may incorporate in addition to the amplifier and wired speakers, the use of an infrared system, much like those used on remote control systems for TV channel changers. This infrared system is capable of communicating with remote powered speakers that are provided with infrared receivers. These remote speakers may also be associated with the Digital Sampling Playback Doorbell to accommodate speakers positioned at a location spaced away from the Digital Sampling Playback Doorbell central unit providing stereophonic improved sound quality.

The central unit can playback 8, 16, and 24 byte samples with various frequencies from 4 –32 KHz, with total memory in RAM of 4 MBs. The larger the sound bit, the fewer sound bits can be stored. Generally, the device is equipped with a 1-bit D/A converter and a 14-bit D/A converter. The device is also wired for low volt circuitry (12 VAC) so as to easily retrofit into an existing doorbell wiring system. It will be sold with a kit to make the conversion simple.

Referring to FIG. 1, the Digital Sampling Playback Doorbell device, shown at 10, has a central unit 11 which is connected to line power as shown at 17. The device 10 is connected by hardwire to a multitude of doorbell devices; in this illustration four doorbells are depicted as an example, and are shown at 12*a*, 12*b*, 12*c*, and 12*d*. Each of the doorbells has its identity marked as shown with markings of.'a','b','c' and 'd'. The Digital Sampling Playback Doorbell device central unit carries a solid state memory in the form of read only memory, as shown at 15, to store a number of digitally sampled sound files which may represent high resolution sampled music, natural sounds, voice or tonal sequences. The user may assign a particular sound file to a particular doorbell. For example, to assign a particular sound file to doorbell button 'a' the user presses and holds the button marked as 'a' at 18 and scrolls up and down the sound files in memory by pressing the up or down arrow buttons marked 21 and 22, respectively. Each of these sound files is played in the speaker system 19 powered by the amplifier at 14. When the user locates a sound file that he wishes to select, the user releases the button marked 'a' thereby assigning the selected sound file to the doorbell marked 'a'. This assignment data is stored in the Digital Sampling Playback Doorbell device central unit in memory marked Assignment at 16. Clearly, more than one doorbell may be assigned the same sound file depending on the user's preference. When the doorbell marked 'a' at 12*a* is pressed by a visitor, the selected sound file is played by the Digital Sampling Playback Doorbell system using the amplifier at 14 through the speaker at 19. The central unit also has an infrared transmitter at 27, which communicates as shown by dotted lines with remote receiver 28 in a remotely powered speaker system 29 located away from the central unit 11.

This Digital Sampling Playback Doorbell system is a simple to manufacture device with a minimum number of components and is able to hold in memory a number of digitally sampled sound files and has the ability to assign a particular sound file to a particular doorbell. It does not have a computer built within the Digital Sampling Playback Doorbell central unit and does not have a keyboard or microphone jacks, etc. It does however have a communication port at 20 for connecting the Digital Sampling Playback Doorbell device to a computer which may be in the form of an RS 232 connection or a USB connection. The details of this functionality are discussed hereinbelow.

Figure 2:
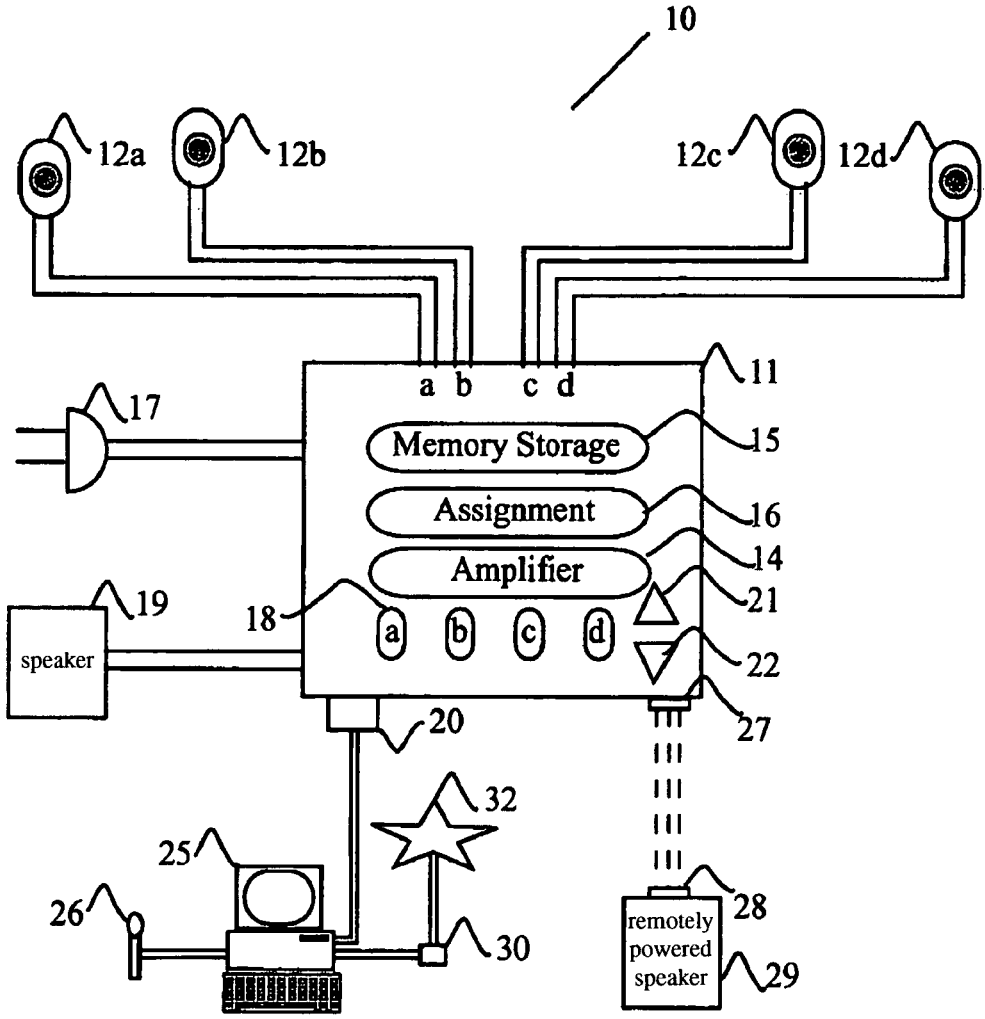
FIG. 2 depicts the schematic arrangement of the Digital Sampling Playback Doorbell system connected through an RS-232 or USB connection to a computer having sound input means and connected to the Internet to access a website containing digitally sampled sound files.

FIG. 2 depicts a schematic of the arrangement of the Digital Sampling Playback Doorbell system central unit when it is connected to a computer through an RS-232 or =USB connection. The computer 25 may be provided with sound input means, which may include a connection to a microphone 26 or a connection to a CD player, a tape player, or a FM or AM radio through sound input jacks (not shown). The computer runs standard software to capture the digitally sampled files and store them in the hard drive of the computer. These sound files may be edited using standard sound manipulation software, which operates by altering the frequency range, adding sounds, deleting sounds, repeating sounds, changing pitch, and the like. These digitally sampled sound files are then downloaded into the Digital Sampling Playback Doorbell memory storage at 15 using specialized software resident in the computer at 25. The downloading process uses the RS 232, or USB connection 20, or an infrared wireless connection (not shown) of the Digital Sampling Playback Doorbell to connect to the computer as shown in FIG 2. As an alternative to recording the digitally simulated sound file, the computer may connect to the Internet at 31 through a PSTN modem, cable modem, or DSL connection shown at 30. The digitally sampled sound file is then downloaded into the computer hard drive from the web site through the Internet. Later, the downloaded digital sound file is downloaded into the memory storage of the Digital Sampling Playback Doorbell at 15 using specialized software resident in the computer.

There may be a large number of digitally sampled sound files within the Digital Sampling Playback Doorbell device, and they are manually assigned individually to a particular doorbell. The computer is needed only to record digitally sampled sound files or to download digitally sampled sound files from an Internet web site. The computer is also needed to download the digitally sampled sound files into the memory storage of the Digital Sampling Playback Doorbell device central unit. At all other times, it is not necessary to have a computer connected to the Digital Sampling Playback Doorbell system.

The key features associated with use of the Digital Sampling Playback Doorbell system include, in combination, the means set forth below:

1. Memory means for storing a multitude of digitally sampled sound files.
2. Programming means for assigning a particular digitally sampled sound clip or file to any one of a plurality of doorbells, which are hardwired to the Digital Sampling Playback Doorbell system.
3. Amplifier and speaker means for playing digitally sampled sound files when a particular doorbell is pressed, according to the user programmed voice, musical or tonal selection.
4. Computer connection means for establishing a connection to a computer through an RS-232, or USB, or infrared wireless connection, and first software means resident in the computer for downloading digitally sampled sound files from the computer hard drive to the Digital Sampling Playback Doorbell system.
5. Imput means connected to the computer through an RS-232, or USB, or infrared wireless connection, and associated with a microphone or external sound input for recording digitally sampled music into the computer's hard drive, and second software means for Internet access means connected to a computer through an RS-232 or USB connection for accessing a web site via the Internet and selecting digitally sampled sound files, and third software means for download the accessed digitally sampled sound files into the Digital Sampling Playback Doorbell system.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A digital sampling playback doorbell, comprising:

a. a central unit connected to electrical outlet power;

b. memory means associated with said central unit for storing a plurality of digitally sampled sound files;

c. connection means for connecting said central unit to a computer and, by hard wiring, to a plurality of doorbell buttons or actuators;

d. program means associated with said central unit for enabling a user to program each of said doorbell buttons to play a particular digitally sampled sound file;

e. sound file playing means associated with said central unit for playing said sound file when said doorbell button is activated;

f. sound file updating means associated with said central unit for updating said digitally sampled sound files through a computer interface connecting said central unit to a computer;

g. Internet access means associated with said computer for establishing an Internet connection and downloading digitally sampled sound files from a web site; and h. input means associated with said computer, said input means having audio input terminals and associated software means for capturing digitally sampled sound files from a sound file source selected from the group consisting of CD player, radio, and microphone;

whereby said digitally sampled sound files in said memory of said central unit are updated according to said user's preferences.

2. A digital sampling playback doorbell as recited by claim 1, wherein said plurality of doorbell buttons or actuators hardwired to said central unit is greater than two.

3. A digital sampling playback doorbell as recited by claim 1, wherein said sound file playing means includes an amplifier and hardwired speakers electrically connected to said central unit.

4. A digital sampling playback doorbell as recited by claim 1 wherein said sound file playing means includes second software means resident in said central unit and a plurality of hardware buttons for sequentially selecting a digitally sampled sound file and assigning it to a specific doorbell button.

5. A digital sampling playback doorbell as recited by claim 1 wherein said connection means establishes said connection to said computer through an RS-232, or USB, or infrared wireless connection.

6. A digital sampling playback doorbell as recited by claim 1, comprising third software means resident in said computer for enabling said central unit to download said digitally sampled sound files from said web site.

7. A digital sampling playback doorbell as recited by claim 1 wherein said software means enables said central unit to download digitally sampled sound files from a CD player.

8. A digital sampling playback doorbell as recited by claim 1 wherein said software means enables said central unit to download digitally sampled sound files from a microphone.

9. A digital sampling playback doorbell as recited by claim 1 wherein said memory means has a memory equal to or greater than 4 MB.

10. A digital sampling playback doorbell as recited by claim 1 wherein said central unit stores sound files of 8 bit samples with frequency data from 4–32 KHz.

11. A digital sampling playback doorbell as recited by claim 1 wherein said central unit stores sound files of 16 bit samples with frequency data from 4–32 KHz.

12. A digital sampling playback doorbell as recited by claim 1 wherein said central unit stores sound files of 24 bit samples with frequency data from 4–32 KHz.

13. A digital sampling playback doorbell as recited by claim 1 wherein said central unit communicates with remote powered speakers transferring said sound files through infra red transmission.

14. A digital sampling playback doorbell as recited by claim 3, wherein said sound file playing capability further includes an infrared transmitter in said central unit and remote powered speakers with infrared signal receivers.

* * * * *